US008739320B1

(12) United States Patent
McTaggart

(10) Patent No.: US 8,739,320 B1
(45) Date of Patent: Jun. 3, 2014

(54) WATERLESS URINAL ODOR TRAP WITH HELICAL FLOW-PATH FINS FOR SEALANT CONSERVATION AND LEVEL-GAUGING

(71) Applicant: James E. McTaggart, Ventura, CA (US)

(72) Inventor: James E. McTaggart, Ventura, CA (US)

(73) Assignee: Waterless Company, Inc., Vista, CA (US)

( * ) Notice: Subject to any disclaimer, the term of this patent is extended or adjusted under 35 U.S.C. 154(b) by 0 days.

(21) Appl. No.: 14/043,851

(22) Filed: Oct. 2, 2013

(51) Int. Cl.
*A47K 11/00* (2006.01)

(52) U.S. Cl.
USPC ..... 4/144.1; 4/301

(58) Field of Classification Search
CPC ..... A47K 11/12; A61G 9/006
USPC ..... 4/144.1, 301, 9
See application file for complete search history.

(56) References Cited

U.S. PATENT DOCUMENTS

| | | | | |
|---|---|---|---|---|
| 303,822 | A | 8/1884 | D'Heureuse | |
| 1,050,290 | A | 1/1913 | Posson | |
| 3,829,909 | A | 8/1974 | Rod et al. | |
| 4,028,747 | A | 6/1977 | Newton et al. | |
| 5,711,037 | A | 1/1978 | Reichardt et al. | |
| 4,244,061 | A | 1/1981 | Webster et al. | |
| 5,203,369 | A * | 4/1993 | Hwang | 137/247.39 |
| 6,053,197 | A | 4/2000 | Gorges | |
| 6,425,411 | B1 | 7/2002 | Gorges | |
| 6,589,440 | B2 * | 7/2003 | Atwill | 4/301 |
| 7,636,957 | B2 * | 12/2009 | Funari | 4/301 |

* cited by examiner

*Primary Examiner* — Huyen Le
(74) *Attorney, Agent, or Firm* — J. E. McTaggart

(57) ABSTRACT

Conservation of oily liquid sealant in coaxial odor trap cartridges for waterless urinals is accomplished in the present invention by the addition of a liquid-flow-diverting structure having at least one helical fin encircling the outer surface of the cylindrical partition that extends downwardly from the cartridge top cap. In a preferred embodiment two similar diametrically-opposed helical fins conserve sealant by modifying the otherwise vertical downward flow path to a downward incline that minimizes down-the-drain sealant loss by intensifying recovery of stray traces of sealant that become detached from the main layer of sealant and get swept along with the downward flow of wastewater in the outer chamber during a usage event. The sealant recovery action of the helical fins that takes place in the outer chamber is further enhanced by specially proportioning the cross-sectional flow area of the three chambers in the cartridge to maximize the cross-sectional flow area of the outer chamber. The upper portion of at least one helical fin may be utilized to implement sealant-level-gauging capability that can be readily observed from above the cartridge. The bottom region of the cartridge is reshaped to provide a drip ring at the base of the stand-tube to facilitate replacement manipulation by preventing migration of wastewater and residue outwardly onto the bottom surface of the cartridge.

11 Claims, 5 Drawing Sheets

WATERLESS URINAL ODOR TRAP WITH HELICAL FLOW-PATH FINS FOR SEALANT CONSERVATION AND LEVEL-GAUGING

PRIORITY

Benefit is claimed under 35 U.S.C. 119(e) of U.S. provisional application No. 61/709,043, filed Oct. 2, 2012.

FIELD OF THE INVENTION

The present invention relates to the field of waterless urinals that save water otherwise lost in flushing, thus providing substantial savings in the costs of water and wastewater treatment as well as conserving fresh water resources. More particularly the invention relates to improvements in coaxial odor trap cartridges for plug-in installation in waterless urinals as the active operational component utilizing an oily or oil-like liquid sealant, the improvements including internal structural additions and modifications that reduce maintenance requirements and costs by conserving sealant, and that further facilitate the low maintenance by enablement of sealant level gauging.

BACKGROUND OF THE INVENTION

With increasing emphasis on water conservation, there is renewed interest in toilets and urinals designed to minimize the amount of water consumed in flushing and thus counteract increasing demands on water supplies as well as on wastewater disposal systems, both of which have tended to become overloaded with increasing populations.

Sanitation codes require all drain-connected items such as bathtubs, sinks, toilets and urinals, to provide an odor seal to contain gasses and odors which develop in the drain system, often developing positive sewer-pressure that can slightly exceed atmospheric pressure. Odor-sealing is conventionally performed by the well known P-trap or S-trap in which the seal is formed by a residual portion of the flushing water. As a marginal inherent disadvantage, P-traps and S-traps can become temporarily disfunctional due to "dry" failure in regions or periods of low humidity where infrequent usage trap could result in depletion of the residual liquid portion by evaporation to the extent that, in an eventual sealing failure, odors would escape.

In the category of urinals for males, "waterless" urinal facilities have been proposed and utilized to some extent in the past for their advantage of substantial savings of water usage and associated cost savings relative to water-flushed facilities. However, as a trade-off for these savings, the most viable approach, a "waterless" odor-trap cartridge for replaceable installation in a urinal bowl and utilizing an oily liquid sealant, still requires maintenance in the form of periodic inspection and replenishment of the oily liquid sealant, compared to relatively lower maintenance requirements of water-flushed urinals. Although not subject to evaporation and associated potential "dry" failure of P and S traps as described above, liquid sealant type waterless urinals generally require maintenance in the form of periodic inspection and replenishment of sealant loss, presumably in small droplets becoming detached from the sealant layer and swept down the drain with the wastewater flow at each usage and/or under surges of intensive usage or pressure hosing. Sealant replenishment is typically required in known waterless urinals after approximately 1,500 usages average, depending on frequency of usage.

In past time periods of plentiful water supply and non-overloaded wastewater disposal facilities, the conventional water-flushed type of urinal became generally accepted and widely used as the standard. More recently, marketplace demand driven by need for water conservation and the benefit of cost savings has resulted in ongoing replacement of pre-existing water-flushed urinals by waterless urinals as well as an increasing role in new construction. Waterless urinals that utilize oily liquid odor sealant have been approved under U.S. plumbing standards, e.g. the American National Standard for Plastic Urinal Fixtures, ANSI Z124.9-1993, particularly section 7.8: "Testing of waterless urinals", and ASUE A112.14.14, and have gained increasing substantial acceptance throughout the world.

It is estimated that each of about 150,000 waterless urinal now in use saves an average of about 30,000 gallons of water per year per urinal compared to a flushed urinal, amounting to a saving of about 45 billion gallons of water annually. The financial savings include not only the initial treated water costs, but even more importantly the costs of sewage water treatment that run typically nearly three times the initial water cost, per gallon.

In many foreign countries, water-saving urinals in a different category, i.e. with moving parts, are allowed and are marketed and used in competition with waterless urinals that utilize liquid odor sealant. This category of urinals with moving parts claim as advantage the potential of being maintenance-free, however, due to awareness of potential risks of inherent unreliability and failure of moving parts due to debris, contamination and/or corrosion, U.S. plumbing and sanitation codes do not recognize or allow the category of odor traps that utilize flap technology, valves or other moving parts, whether of metal or flexible material.

DISCUSSION OF KNOWN ART

A wastewater pipe S-trap into which a disinfectant or deodorizer is introduced was disclosed in U.S. Pat. No. 303,822 to D'Heureuse.

The use of an oil as a recirculated flushing medium in a toilet system was disclosed in U.S. Pat. No. 3,829,909 to Rod et al.

The use of oil in toilets to form an odor trap has been disclosed in German patent 121356 to Beck et al and in U.S. Pat. Nos. 1,050,290 to Posson and 4,028,747 to Newton.

German patent 72361 to Beetz in 1891 disclosed an oil-sealed odor lock for stall urinals: a partitioned cylindrical liquid compartment forms a bell trap having an oily liquid barrier that forms a seal through which urine permeates downwardly. Due to its configuration and cast iron metal structure, the Beetz odor lock was made of three parts and designed for easy disassembly since this was required for daily maintenance: cleaning and coating the internal parts and surfaces with oil to prevent clinging of the urine, according to the Beetz specification; however, even such daily maintenance failed .to corrosion of the metal parts rendering the trap useless.

A more recent version of the Beetz coaxial oil-sealed waterless urinal, related to German patent 28 16 597.1, and Swiss patent 606 646, trademarked SYSTEM-ERNST, has been used publicly in Europe: typically the liquid compartment odor trap is mounted beneath floor level and embedded in a concrete swale that functions as a trough type or stall urinal of a type which is no longer recognized in U.S. building and sanitation codes.

A flushless urinal disclosed in U.S. Pat. No. 4,244,061 to Webster et al uses no oil and instead of complete sealing it relies on a small "plug flow" entrance opening associated with a P trap, and is based on the premise that "the urine in the trap during normal use will be fresh and therefore without unpleasant odour".

.U.S. Pat. Nos. 6,053,197 and 6,425,411 B1 to Gorges disclose liquid sealant type odor trap cartridges that, while made cylindrical in external shape for urinal bowl installation, are configured internally with structure that is clearly non-concentric in shapes representing distinctive approaches to preservation of oil sealant.

U.S. Pat. No. 5,711,037 to Reichardt et al disclosing a WATERLESS URINAL utilizing an oily liquid sealant type odor trap cartridge of totally concentric structure, both externally and internally, that has earned worldwide success and that has saved many millions of gallons of water, is incorporated herein by reference for purposes of detailed description, since it provides the basis upon which the improvements disclosed herein have been accomplished. Field experience with the waterless urinal odor trap cartridge disclosed in the '037 patent has established levels of performance standards and maintenance requirements that serve as reference benchmarks with which to relate the improvements provided by the present invention.

The continued and further increasing emphasis on the economy of conserving water consumption and reducing the risks of overloading existing wastewater and sewage systems have motivated pursuit of the present invention to further develop and refine co-axial oil-sealed waterless urinal cartridges with particular emphasis on the competitive importance of further reducing maintenance requirements by preservation of the liquid sealant through more complete rescue and recovery of detached escaping traces or droplets of sealant.

OBJECTS OF THE INVENTION

It is a primary object of the present invention to provide improvements for incorporation into a known totally coaxial oil-sealed odor trap cartridge for installation in a no-flush waterless urinal, the improvements representing an advancement of the state of the art in this technology to a reduced level of maintenance requirements directed to increasing sales and utilization of this technology, yielding associated benefits of increased conservation of fresh water and substantial savings in water costs and in wastewater treatment costs.

It is a further object to provide the desired improvements through modifications in the internal structure of an existing coaxial odor trap cartridge that will continue to be economical and readily producible in manufacture, and interchangeable with current plug-in odor trap cartridges in existing urinal bowls.

It is a still further object to provide sealant level gauging for purposes of facilitating maintenance monitoring, being readily viewable by a user from above the cartridge.

It is a still further object, in the discharge from the low end of the stand-tube to the drain, to prevent the discharged wastewater and accompanying debris from migrating outwardly onto the bottom surface of the cartridge where it interferes with cartridge replacement handling.

SUMMARY OF THE INVENTION

The above-mentioned objects and advantages have been realized in the present invention by improvements in coaxial oil-sealed odor trap cartridges for waterless urinals accomplished by the addition of at least one helically-shaped fin added to extend outward from the outer surface of the cylindrical partition that extends downwardly from the cartridge top cap. In a preferred embodiment two similar fins are added, each shaped as a helix that extends from top to bottom of the tubular partition. To further the benefit of the fin(s) in redirecting escaping droplets of sealant back to the sealant layer, the cross-sectional flow areas of the outer down-flow intake chamber, the intermediate up-flow chamber and the stand-tube down-flow exit chamber are specially proportioned to maximize the cross-sectional flow area of the intake chamber and thus maximize the area of the fin(s) that is active in redirecting and thus preserving traces of sealant that would otherwise escape down the drain. As further improvements and benefits, (a) the structure at the upper portion of the fin(s) enables implementation of sealant level gauging capability that can be observed from above the cartridge, and (b) the bottom region of the cartridge is reshaped to provide a drip ring at the base of the stand-tube to ensure that all wastewater and residue are released directly into the drain and prevented from migrating outwardly and fouling the bottom surface of the cartridge.

BRIEF DESCRIPTION OF THE DRAWINGS

The above and further objects, features and advantages of the present invention will be more fully understood from the following description taken with the accompanying drawings in which.

DETAILED DESCRIPTION

Figure 1:
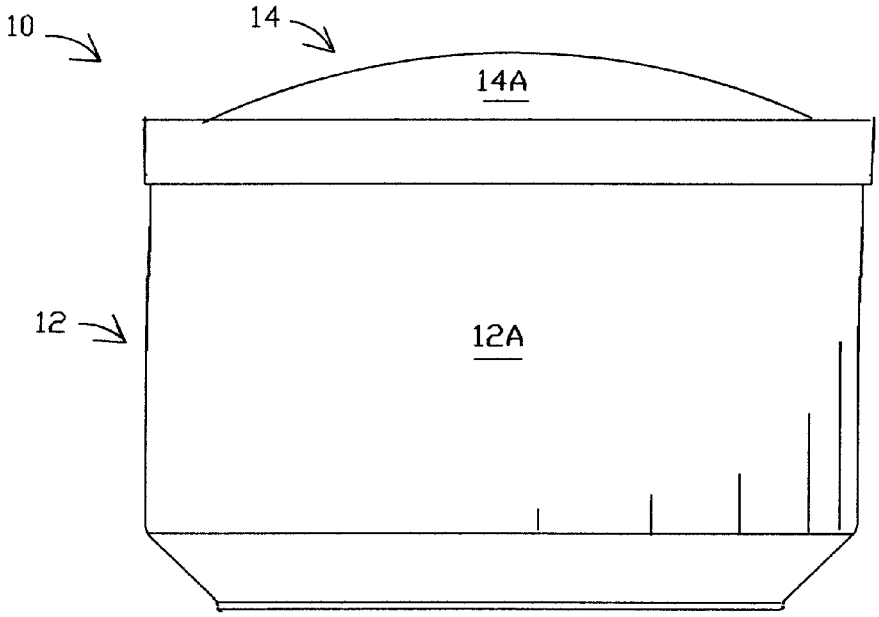
FIG. 1 is an elevational view showing the external appearance of a known coaxial odor trap cartridge for installation and usage in a waterless urinal.

FIG. 1 is an elevational view showing the external appearance of a replaceable odor trap cartridge 10 for use in a mating waterless urinal fixture. Included in the category having this general appearance are a product line of well-known odor trap cartridges utilizing oily liquid sealant, typified by the main product of the Waterless Company, a coaxial odor trap cartridge which was disclosed in the above-mentioned '037 U.S. patent, and which has been marketed widely in the U.S. since 1991 and worldwide since 1998. This view shows the exterior of two main portions of cartridge 10: (1) the main enclosure 12 with its cylindrically-shaped outer sidewall 12A and (2) the cap/partition portion 14, of which the upper surface of cap 14A is shown in profile. This exterior view also generally represents the outward appearance of an embodiment of the presently disclosed invention that is intended to be mutually interchangeable physically with the present Waterless urinal cartridge product as disclosed in the above-mentioned '037 U.S. Patent.

Figure 2:
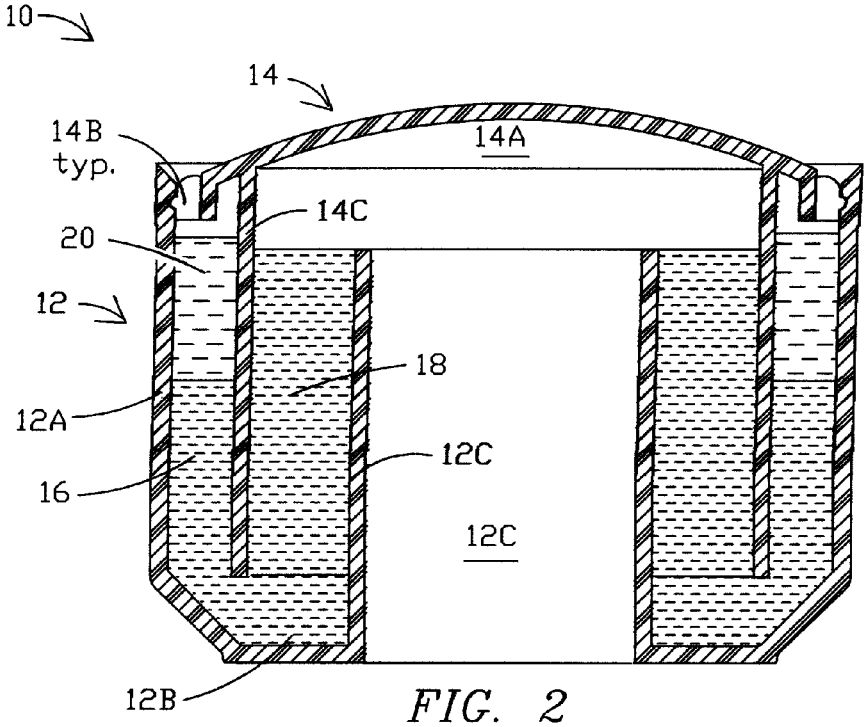
FIG. 2 PRIOR ART
FIG. 2 is a cross-section of a known odor trap cartridge having an external appearance as in FIG. 1.

FIG. 2 is a cross-section taken through the central axis of a known replaceable co-axial odor trap cartridge 10 having exterior appearance as shown in FIG. 1, applicable to the aforementioned Waterless liquid-sealant-based coaxial product disclosed in the '037 patent.

The main body portion 12 includes the cylindrical outer sidewall 12A extending downwardly past a chamferred lower region to a generally flat bottom panel 12B, configured centrally with a integral tubular stand-tube 12C extending upwardly to an open top end as shown, located at a designated distance below the upper edge of the outer sidewall 12A.

The cartridge 10 is molded from suitable plastic such as polypropylene in two parts, i.e. the main cartridge body portion 12 and the cap/partition portion 14. When assembled together these form three concentric annular liquid chambers: (1) the outer down-flow intake chamber between outer sidewall 12A and partition 14C, (2) the intermediate up-flow chamber between partition 14C and stand-tube 12C, and (3) the tubular central down-flow exit drain chamber formed by stand-tube 12C. Chambers (1) and (2) communicate in a common lower chamber region immediately above the bottom panel 12B, while chambers (2) and (3) communicate in the region beneath cap 14A.

Partition 14C is secured firmly to the main body portion 12 at the upper region thereof by an array of 20 spacers 14B molded around the edge of cap 14A, each including a small protrusion for engaging an annular groove configured around the inner surface of sidewall 12A of main body 12, such that cap/partition portion 14 and main body portion 12 can be easily assembled and held firmly together in a detent action. To provide strength for such detent action and for mounting purposes, a thickened and tapered rim is formed at the upper peripheral edge of outer sidewall 12A.

In the known odor seal cartridge 10, the lower edge of tubular partition 14C engages a set of four support pedestals formed integrally with the floor 10D and arranged in a circular array. The upper end of each pedestal is formed with a channel for engaging the lower edge of partition 14C to ensure concentricity.

In the outer region of the liquid chamber, sealing is provided by a body of oily liquid sealant 20 that has a lower specific gravity, preferably less than 0.9, compared to 1.0 for water or urine/wastewater, since the operation of the urinal is based on the differential between the specific gravity of the oily liquid 20 and that of urine/wastewater 18, typically near 1.0. A preferred composition of the oily liquid 14 comprises an aliphatic alcohol containing 9-11 carbons in the chemical chain: the specific gravity is 0.84 at 68 degrees, the specific gravity of the oily liquid should be made as low as possible, preferably under 0.9. At the top surface of the sealant 20, newly received urine immediately permeates downwardly in a turbulent flow through and past the outer edge of the body of sealant 20 floating on the upper surface of the wastewater 16 in the outer down-flow entry chamber. The flow path proceeds past the bottom of partition 14C and then the wastewater 18 flows upwardly in the intermediate liquid chamber to the top of stand-tube 12C where it overflows and runs down though stand-tube 12C to an external drain system. The sealant 20 remains in place floating on top as shown where it serves as an odor and gas seal.

In addition to permeation through sealant 20 as described above, since urine 16 is introduced from cap portion 12A, close to the outer edge as shown, some of the urine 16 tends to divide into droplets and gravitate downwardly, initially concentrated at the inner wall surface of the outer liquid chamber, thus furthering both the disposal and the sealing performance.

As part of normal operation small traces of sealant 20 become separated from the main body and swept along with the downward wastewater flow in the outer entry chamber, where the detached sealant traces are acted upon by two opposing forces: (1) a downward drag force from the downward flow of wastewater during each urinal usage and for a settling time afterwards as the downward drag force decays to zero unless the settling time is cut short by a subsequent usage, and (2) a constant upward buoyant force due to the low specific gravity of the sealant 20. The net result of these forces acts on the sealant traces to assert their inherent water-repellence and move upwardly. A portion (a) of the sealant traces remaining in the outer down-flow intake chamber will rise and return to the main sealant body while the other portion (b) of sealant traces that get carried under the partition 14C will then rise into the intermediate up-flow chamber and become lost down the drain.

In the known odor trap cartridge of the '037 patent the dimensioning of the three chambers result in approximately the following cross-sectional flow areas and volumes:

TABLE 1

| | Chamber diameter at outer wall of chamber | Cross-sectional flow area | Chamber volume (depth = 5.3 cm) |
|---|---|---|---|
| down-flow exit stand-tube | 2.68 cm | 11.74 cm^2 | 62.2 cc |
| intermediate up-flow chamber | 8.3 cm | 37.94 cm^2 | 201.8 cc |
| outer down-flow intake chamber | 10.1 cm | 39.61 cm^2 | 209.9 cc |

In the known odor trap cartridge of the '037 patent, a 3 fluid ounce charge of sealant 20, having a volume of 88.72 cc, will have a depth of 88.72/39.61=2.24 cm, i.e. 42.2% of the 5.3 cm chamber height, and typically requires replenishing after about 1500 average usages, thus there is a loss of about 0.06 cc per usage. The 3 fluid ounce charge is considered to be an optimal tradeoff between a smaller charge that would require more frequent replenishment and a larger charge that would extend further down, requiring the urine to penetrate a thicker layer of sealant, and reducing the flow path length in the region beneath the sealant body, thus reducing the odds of recovering detached traces of sealant, i.e. actually increasing the sealant loss. The sealant 20 is dyed a blue color and is made biodegradable to prevent escaping traces from harming the environment.

The present invention is directed primarily to improvements from modifications and additions in the internal structure of the coaxial odor trap cartridge of the '037 patent that act to substantially increase the recovery ratio: portion (a)/portion (b) of the detached sealant traces, thus conserving more of the sealant 20 and reducing maintenance costs and requirements of waterless urinals.

Figure 3:
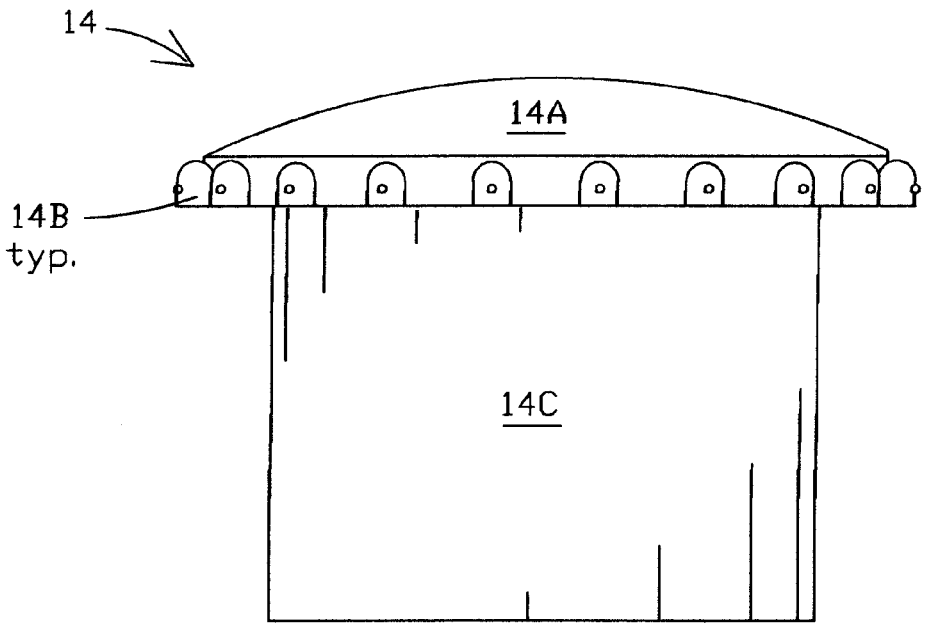
FIG. 3 PRIOR ART
FIG. 3 is an elevational view of the cap/partition portion shown removed from the main body portion of the known odor trap of FIG. 2.

FIG. 3 is an elevational view of the cap/partition portion 14 shown removed from the main body portion 12 of the known odor trap 10 of FIG. 2.

Figure 4:
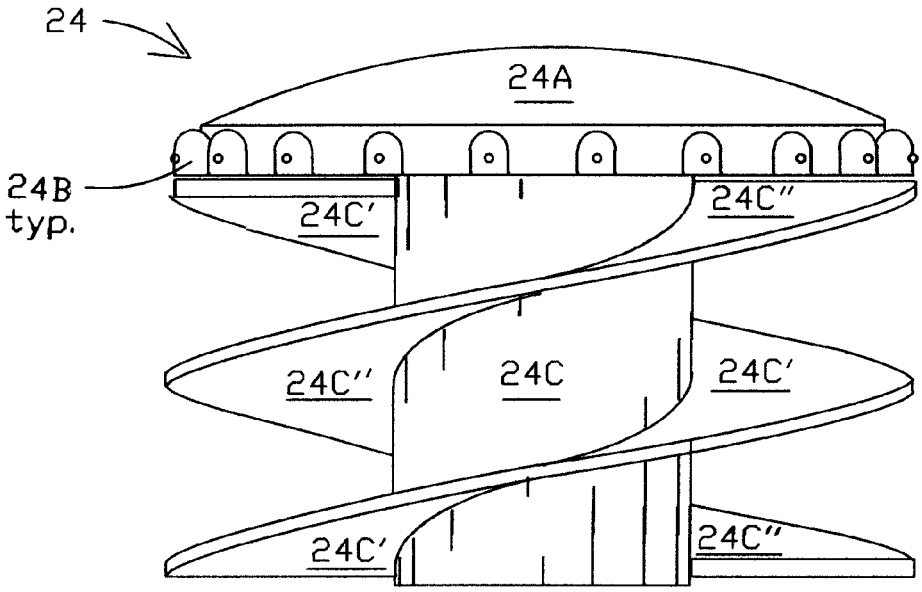
FIG. 4 is an elevational view of a cap/partition portion of a sealant-preserving odor trap cartridge in accordance with a preferred embodiment of the present invention, shown removed from the main body portion as the functional replacement counterpart of the known cap/partition portion in FIG. 3.
Figures 9, 9A, 9B, 9C, 9D:
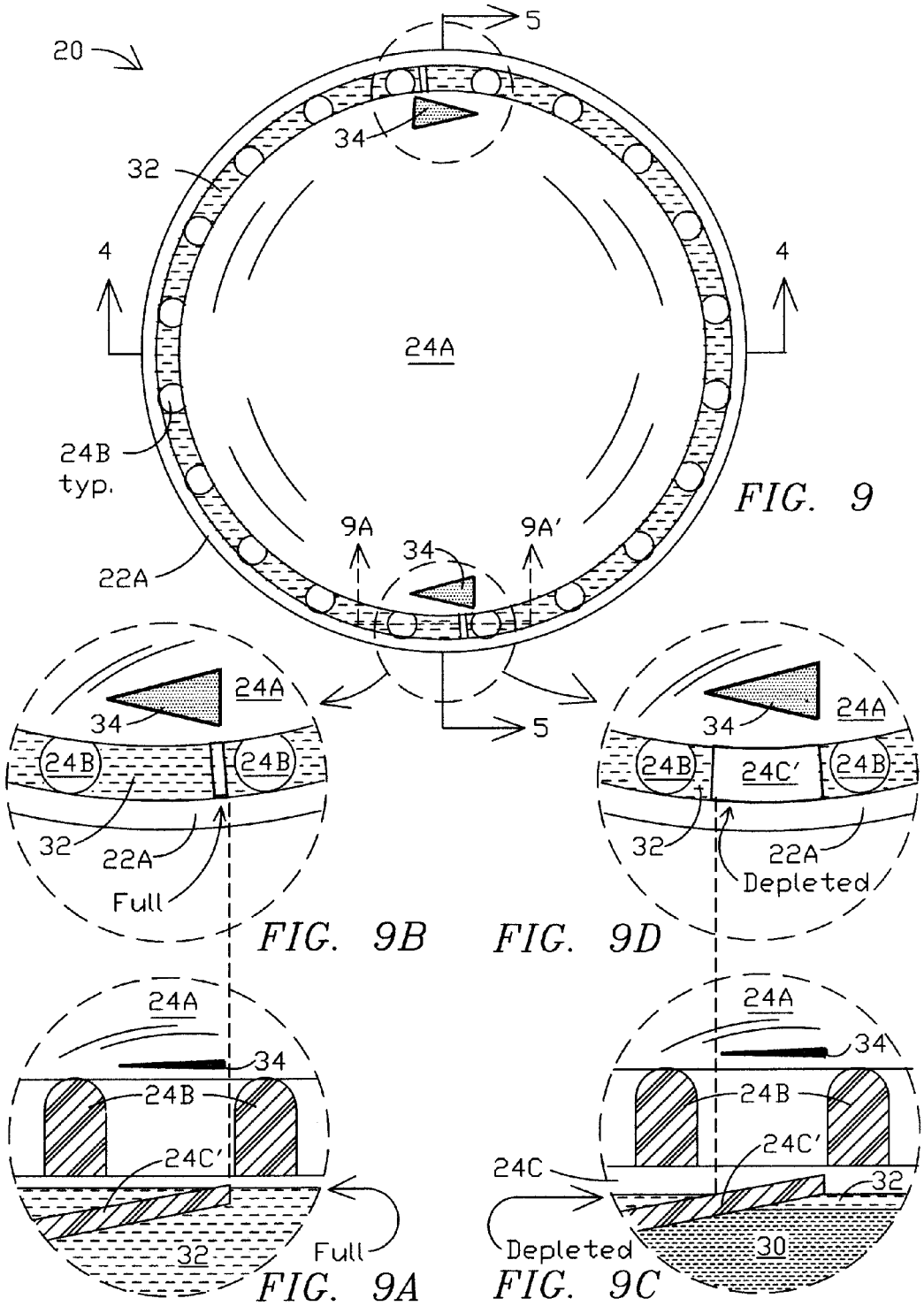
FIG. 9 is a top view of an embodiment of the present invention including a novel sealant level gauge system.
FIGS. 9A and 9B show details, in vertical cross-section and as viewed from above, of the sealant level gauge system of FIG. 9 indicating a full sealant condition.
FIGS. 9C and 9D show details, in vertical cross-section and as viewed from above, of the sealant level gauge system of FIG. 9 indicating a depleted sealant condition.

FIG. 4 is an elevational view, in direction 9-9 of FIG. 9, of a cap/partition portion 24 of a sealant-preserving odor trap cartridge in accordance with a preferred embodiment of the present invention, shown removed from the main body portion 12 as the functional replacement counterpart of the known cap/partition portion 14 in FIG. 3. In comparison, the novel partition 24C (FIG. 4) is made much smaller in diameter and is configured with a diametrically-opposed pair of fins 24C' and 24C" that each encircle the main tubular portion 24C with a single full 360 degree revolution, each forming a helix with a slope of about 10 degrees.

Fins 24C' and 24C" extend outward radially, typically configured with a horizontally-oriented elongate rectangular cross-sectional shape typically made with the same material and thickness as the cylindrical partition 24C, e.g. polypropylene, approximately 1.5 mm thick.

As a matter of design choice, taking into account potential impact on performance, the invention could be practiced with an alternative number of fins, e.g. 1, 3 or more, and the helix formed by each fin could be made to extend to more or less than the single 360 degree encirclement of tubular partition 24C as shown, and to slope more or less than the 10 degrees angle shown as an illustrative embodiment, or even configured with compound, segmented or smoothly varying slopes. The downward flow path, as viewed from above, could be made counterclockwise, as an alternative to the clockwise direction shown.

Figure 5:
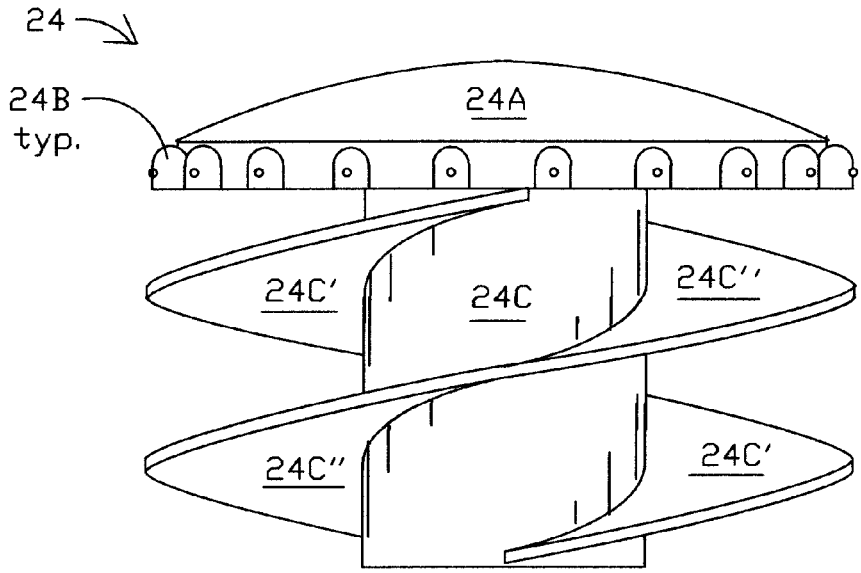
FIG. 5 shows the subject matter of FIG. 4 as viewed from a perpendicular direction.

FIG. 5 shows the subject matter of FIG. 4, viewed in direction 5-5 of FIG. 9, i.e. perpendicular to the direction 4-4-in FIG. 4, showing the relationship between the upper edge of the fin 24C' and the two nearest ones of the spacers 24B formed around the perimeter of cap 24A with an opening between them that will be utilized to enable implementation of sealant level gauging capability. A view from the opposite side would show fin 24C"in the same relationship with the corresponding two spacers 24B. The sealant level gauging system enabled by this relationship is described below in connection with FIGS. 9-9D.

Figure 6:
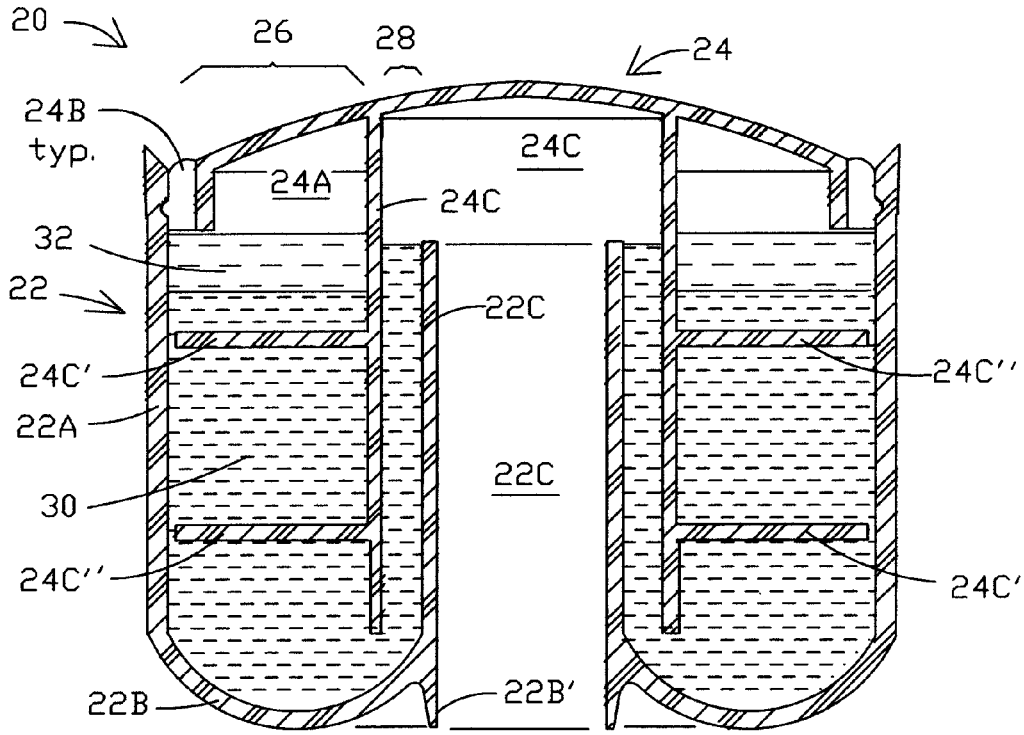
FIG. 6 is a cross-section of an odor trap cartridge in accordance with a preferred embodiment of the present invention, utilizing finned cap/partition structure as in FIGS. 4 and 5.

FIG. 6 is a cross-section of an odor trap cartridge 20 in accordance with a preferred embodiment of the present invention, utilizing finned cap/partition structure 24 as in FIGS. 4 and 5. The fins 24C' and 24C", extending outwardly as shown, are dimensioned to provide a working sliding fit at the inner surface of cylindrical sidewall 22A that enables easy assembly insertion and maintains the concentric location of partition 24C with no need for support spacers under the partition such as have been utilized in known odor trap cartridges.

The helical flow paths provided by fins 24C' and 24C" conduct the wastewater downward indirectly in a long slope at a shallow angle of about 10 degrees as apposed to the short, direct vertical flow path in the known odor trap cartridge, e.g. as disclosed in the '037 patent and described above in connection with FIG. 2.

This redirection of the flow path onto and down the helical fins 24C' and 24C" serves to preserve sealant by prolonging the time period for traces of sealant 32, that have become detached from the main sealant body and temporarily caught up in the wastewater flow, to disassociate from the wastewater and migrate upwardly while still within the outer chamber where they will automatically float upwardly and rejoin the overhead main sealant body. This separating tendency is continuous due to the constant upward force from the inherent buoyancy of the sealant traces, but the actual separation is an ongoing process that takes place over time.

During usage events, the active flow of wastewater 30 down the fins 24C' and 24C" will tend to separate into a quasi-laminar flow with the densest portion (e.g. metallic compounds) at the lowermost laminations of the flow in the sloping passageway and the least dense in the upper laminations, e.g. traces of sealant whose inherent upward buoyancy force will act to at least slow down the flow rate of the upper flow laminations, possibly stopping or even reversing it; in any case, increasing the percentage of sealant traces that have had time to detach and migrate upwardly to rejoin the main body. This recovery action intensifies and the recovered percentage further increases during the ensuing settling time period following a usage event, as the main lower lamination flow rate decays and the upper laminations carrying sealant traces typically reverse direction and move upwardly at an increasing flow rate. Finally, at the conclusion of the settling time period, with the main flow settled to zero, in the absence of a subsequent usage event, 100% of sealant traces remaining anywhere on the relatively large (compared to known art) area of the top side of the fins will sooner or later yield to their buoyancy force, disassociate from surrounding wastewater and float back up through the helical passageways to rejoin the main body of sealant.

The bottom panel 22B is made in the modified arcuate cross-sectional shape as shown forming a drip ring 22B' which serves to prevent outward radial migration of wastewater and debris onto the bottom surface of bottom panel 22B; instead drip ring 22B' is shaped to discharge all wastewater and debris directly into the drain, thus preventing annoying bottom-side pollution in maintenance replacement handling.

In comparison to the dimensional information regarding the three chambers of the known odor trap cartridge of the '037 patent as shown in Table 1 above, the following Table 2 shows the modified dimensioning of the cap/partition 24 of the odor trap cartridge 20 of the present invention:

TABLE 2

| | Outer diameter of chamber | Cross-sectional flow area | Chamber volume (depth = 5.3 cm) |
|---|---|---|---|
| down-flow exit stand-tube | 2.69 cm | 5.67 cm^2 | 30.05 cc |
| intermediate up-flow chamber | 4.06 cm | 5.67 cm^2 | 30.05 cc |
| outer down-flow intake chamber | 10.1 cm | 80.1 cm^2 | 424.5 cc |

Comparing Table 1 (previous) and Table 2 (present), while the exterior size and shape of the odor trap cartridge and thus the exterior diameter of the outer down-flow intake chamber all remain practically unchanged in order to retain cartridge interchangeability, the stand-tube cross-sectional area has been reduced to 50% of previous and the intermediate chamber cross-sectional area is now reduced to 15% of its previous value to make it equal to that of the stand-tube.

Since the re-proportioning increased the volume of the outer down-flow entry chamber to more than twice its former value, retaining the established 2.31 cm sealant depth now allows the former 3 fluid ounce charge and the expected sealant life expectancy to be more than doubled, even without the addition of the fins 24C' and 24C".

The addition of the fins 24C' and 24C" is estimated to have the potential of at least further doubling the sealant life expectancy for a total estimated increase to over 4 times the former life expectancy by altering the travel path of the wastewater from the essentially vertical downward path in coaxial odor trap cartridges of known art, e.g. as in the '037 patent. The proportioning of the chambers described above represents a preferred embodiment considered to be generally optimal overall, however the helical fin concept of the present invention can be practiced with practically any selected proportioning of the chambers with varying impact on performance results regarding sealant preservation.

As a design option, in a preferred embodiment the fins 24C' and 24C"are molded integrally as part of the tubular partition 24C. Alternatively; the fin(s) could be molded integrally as part of the outer sidewall 22A, or else fabricated separately, made and arranged to be deployed as a stand-alone component or to be attached adhesively or otherwise to tubular partition 24C or to outer sidewall 22A.

Figure 7:
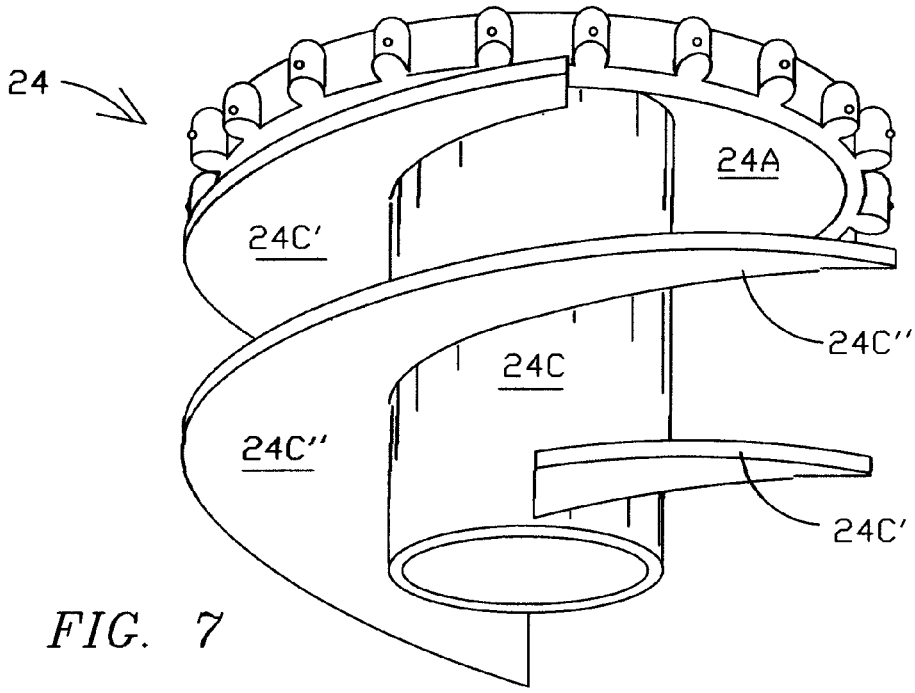
FIG. 7 is a perspective view of the subject matter of FIG. 5.

FIG. 7 is a perspective view of the subject matter of FIG. 5 taken from a viewpoint that is at a lower level than the bottom end of partition 24C, showing a portion of the underside of cap 24A.

Figure 8:
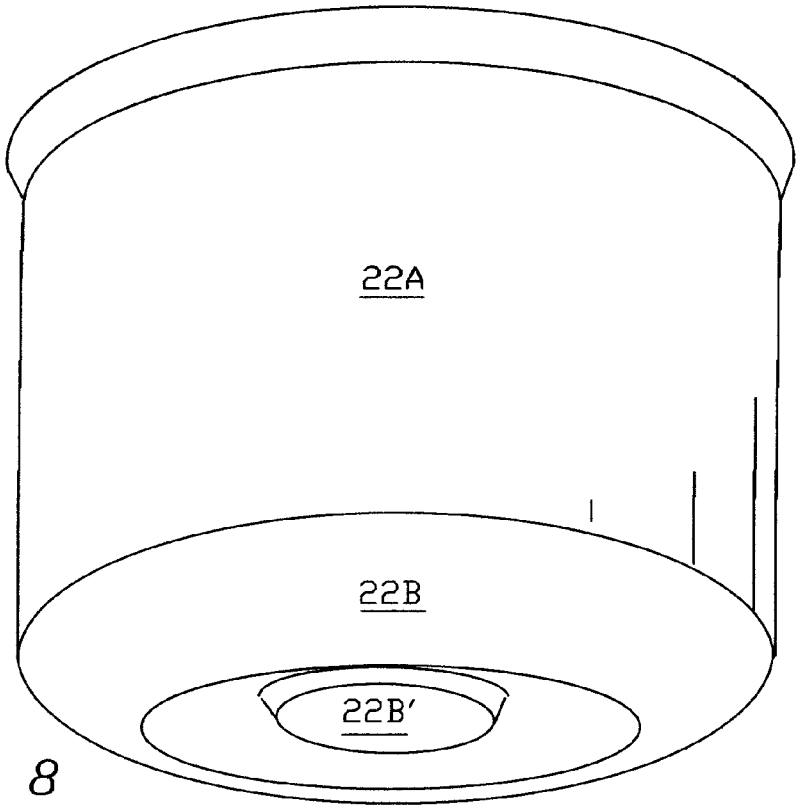
FIG. 8 is a perspective view of an embodiment of the present invention showing a novel drip ring configured in the bottom region.

FIG. 8 is a perspective view of an embodiment of the present invention, taken from the same viewpoint as in FIG. 8, showing the cylindrical sidewall 22A and the arcuate bottom panel 22B, configured with the novel drip ring 22B'.

FIG. 9 is a top view of an embodiment of an odor trap 20 in accordance with the present invention indicating the cross-sectional axes of FIGS. 4, 5 and 9A, and including a novel sealant level gauge system including the two encircled directional symbols 34 marked on the cap 24A. The visibility of sealant 32 from above is indicated in the peripheral entry openings bounded by cap 24A, cylindrical sidewall 22A and adjacent spacers 24B.

FIG. 9A is an enlarged cross-section, taken at axis 9A-9A' of FIG. 9, showing details of the sealant level gauge system of the present invention indicating a full sealant condition. A narrow portion of fin 24C' appears above the surface level of the sealant 32, near the right hand end of the opening between two spacers 24B corresponding to the wide end of triangular marking 34 on cap 24A.

FIG. 9B is an enlarged top view of the lower circled portion of FIG. 9, showing the sealant level gauge system of the present invention indicating a full sealant condition. A narrow portion of fin 24C' appears above the surface level of the sealant 32, near the right hand end of the opening between two spacers 24B corresponding to the wide end of triangular marking 34 on cap 24A.

FIG. 9C is an enlarged cross-section, taken at axis 9A-9A' of FIG. 9, showing details of the sealant level gauge system of the present invention indicating a depleted sealant condition. A relatively wide portion of fin 24C' appears above the surface level of the sealant 32, approximating full width of the opening between two spacers 24B and corresponding to the full length of triangular marking 34 on cap 24A.

FIG. 9D is an enlarged top view of the lower circled portion of FIG. 9, showing details of the sealant level gauge system of the present invention indicating a depleted sealant condition. A relatively wide portion of fin 24C' appears above the surface level of the sealant 32, approximating full width of the opening between two spacers 24B and corresponding to the full length of triangular marking 34 on cap 24A.

The sealant level gauge system shown in FIGS. 9-9D represents an illustrative embodiment that teaches the basic concept of utilizing an upper end portion of one or more fins 24C' of the invention to serve as the basis of a sealant level gauge system. This basic concept could be practiced with alternative details such as applying a special coloring or coating on the upper portion of the fins to enhance visibility, modifying the slope of the fin(s) in this upper region, modifying the spacing between spacers 24B, e,g, omitting one or more of these spacers 24B from the array, and arranging for some form of illumination to increase the visibility of the gauge in a dark environment.

A further option regarding sealant level indication would be an indicator lamp, typically LED, connected to a pair of electrodes extending into the sealant layer, where they would conduct or generate electric current and illuminate the lamp only in the event that sealant depletion allows the electrodes to come in contact with the conductive wastewater instead of the normal contact with only the non-conductive sealant.

The invention may be embodied and practiced in other specific forms without departing from the spirit and essential characteristics thereof. The present embodiments are therefore to be considered in all respects as illustrative and not restrictive, the scope of the invention being indicated by the appended claims rather than by the foregoing description; and all variations, substitutions and changes which come within the meaning and range of equivalency of the claims are therefore intended to be embraced therein.

What is claimed is:

1. A low-maintenance oil-sealed odor trap cartridge for installation in a waterless urinal, comprising an outer chamber having a substantially vertical outer wall that extends around a continuous loop, configured with a level upper rim and extending downwardly therefrom;

a bottom plate that extends inwardly from a lower edge of the outer wall to a central exit opening;

an exit stand-pipe with a bottom end forming an upward continuation of the central exit opening, extending upwardly therefrom to a designated overflow level near the level of the upper rim;

a cover that extends outwardly so as to engage the upper rim and that is configured with urine entry openings made and arranged to direct urine from above to enter said outer chamber;

a partition wall having an upper end attached to said cover, extending around a continuous loop located between the outer wall of said chamber and said exit stand-pipe, extending vertically down to a level lower end located at a designated clearance dimension from said bottom plate, thus forming an inner wall surface of said outer chamber and an outer wall surface of an inner chamber having an inner wall surface formed by an outer surface of said exit stand-pipe;

a liquid-flow-diverting structure having at least one helical fin, located within said outer chamber and configured with a flat horizontal cross-sectional shape extending between an outer wall surface of said partition and an inner wall surface of said outer chamber, extending around at least a portion of said partition in an inclined helix shape from a top helix end located in an uppermost region of said outer chamber wall to a bottom helix end located in a lowermost region of said partition wall; thus creating a liquid flow path that descends in said outer chamber in a helical path directed by said liquid-flow-diverting structure to a bottom region thereof, thence in a horizontal inward radial direction, flowing under the lower end of said partition wall, upwardly in the inner chamber to the overflow level, thence further horizontally and radially inwardly, flowing over the upper end of said partition wall thence downwardly through said exit stand-pipe and the bottom exit opening to an external wastewater drainage system.

2. The low-maintenance oil-sealed odor trap cartridge as defined in claim 1 wherein said exit stand-pipe, said partition wall and the vertical wall of said outer chamber are each cylindrical in shape and, along with said liquid-flow-diverting structure, are located co-axially about a vertical central axis.

3. The low-maintenance oil-sealed odor trap cartridge as defined in claim 2 wherein said liquid-flow-diverting structure comprises two similar helical fins disposed co-axially about the vertical central axis, diametrically opposite each other.

4. The low-maintenance oil-sealed odor trap cartridge as defined in claim 3 wherein each of said two helical fins is configured to extend one complete revolution, 360 degrees about the vertical central axis.

5. The low-maintenance oil-sealed odor trap cartridge as defined in claim 1 wherein said liquid-flow-diverting structure comprises only one helical fin.

6. The low-maintenance oil-sealed odor trap cartridge as defined in claim 1 further comprising a drip ring configured in the bottom surface of said cartridge, at the base of the stand-tube, made and arranged to ensure that all wastewater and residue are released directly into the drain are prevented from migrating outwardly and fouling the bottom surface of the cartridge.

7. A liquid-flow-diverting structure incorporated as an improvement for sealant conservation in an oil-sealed urinal odor trap cartridge of a known category having typically a cylindrical enclosure with a watertight bottom portion, a circular top cover fitted onto the enclosure and configured with edge openings for liquid entry from above into the enclosure, a co-axial tubular exit stand-pipe extending upwardly from a circular exit opening in the bottom portion to an overflow level near the top cover, and a tubular partition extending downwardly from the top cover, located coaxially between the enclosure and the exit stand-pipe thus forming an outer chamber between the enclosure and the partition, and an inner chamber between the partition and the exit stand-pipe, the partition extending down to a bottom level defining there a passageway for liquid flow from the outer chamber to the inner chamber, said liquid-flow-diverting structure comprising:

at least one helical fin, located within the outer chamber and configured with a flat horizontal cross-sectional shape extending between an outer wall surface of the partition and an inner wall surface of the outer chamber, extending around at least a portion of the partition in an inclined helix shape from a top helix end located in an uppermost region of the outer chamber wall to a bottom helix end located in a lowermost region of the wall; thus creating a liquid flow path that descends in the outer chamber in a helical path directed by said liquid-flow-diverting structure to a bottom region thereof, thence in a horizontal inward radial direction, flowing under the lower end of the partition wall, upwardly in the inner chamber to the overflow level, thence further horizontally and radially inwardly, flowing over the upper end of the partition wall thence downwardly through the exit stand-pipe and the bottom exit opening to an external wastewater drainage system.

8. The liquid-flow-diverting structure as defined in claim 7 wherein the exit stand-pipe, the partition and the vertical wall of the outer chamber are each cylindrical in shape, and, along with said liquid-flow-diverting structure, are located co-axially about a vertical central axis.

9. The liquid-flow-diverting structure as defined in claim 8 comprising two similar helical fins disposed co-axially about the vertical central axis, diametrically opposite each other.

10. The liquid-flow-diverting structure as defined in claim 9 wherein each of said two helical fins is configured to extend one complete revolution, 360 degrees about the vertical central axis.

11. The liquid-flow-diverting structure as defined in claim 7 comprising only one helical fin.

* * * * *